US007975807B2

(12) United States Patent
Franklin

(10) Patent No.: US 7,975,807 B2
(45) Date of Patent: Jul. 12, 2011

(54) ELEVATOR CLIMBING SYSTEM

(76) Inventor: Samuel H. Franklin, Tulsa, OK (US)

( * ) Notice: Subject to any disclaimer, the term of this patent is extended or adjusted under 35 U.S.C. 154(b) by 295 days.

(21) Appl. No.: 11/964,004

(22) Filed: Dec. 24, 2007

(65) Prior Publication Data

US 2008/0190706 A1 Aug. 14, 2008

Related U.S. Application Data

(63) Continuation-in-part of application No. 10/760,751, filed on Jan. 20, 2004, now Pat. No. 7,311,179.

(51) Int. Cl.

| | |
|---|---|
| ***B66B 9/00*** | (2006.01) |
| ***B66B 9/16*** | (2006.01) |
| ***B66B 9/02*** | (2006.01) |
| ***E04G 3/28*** | (2006.01) |

(52) U.S. Cl. ..... 187/239; 187/241; 187/270; 187/351; 187/377; 182/144; 182/145; 182/148

(58) Field of Classification Search ..... 187/239, 187/270, 210, 236, 250, 241, 351, 377; 182/142, 182/144, 145, 148; *E04G 1/22, 1/18, 3/28*
See application file for complete search history.

(56) References Cited

U.S. PATENT DOCUMENTS

| | | | | | |
|---|---|---|---|---|---|
| 105,177 | A | | 7/1870 | Copeland | |
| 197,709 | A | * | 11/1877 | Winkless | 182/142 |
| 205,537 | A | | 7/1878 | Garrison | |
| 236,184 | A | | 1/1881 | Schmidt | |
| 527,894 | A | | 10/1894 | Smith | |
| 651,236 | A | * | 6/1900 | Corcoran | 187/250 |
| 749,406 | A | * | 1/1904 | Spiro | 182/142 |
| 1,004,689 | A | * | 10/1911 | Raymer | 182/53 |
| 2,085,230 | A | * | 6/1937 | Rosenberg | 60/469 |
| 2,121,906 | A | * | 6/1938 | Dunn | 74/89.21 |
| 2,297,359 | A | * | 9/1942 | Lewis et al. | 187/291 |
| 2,903,100 | A | * | 9/1959 | Freeman | 188/349 |
| 2,931,265 | A | * | 4/1960 | De Lacy | 411/403 |
| 3,127,957 | A | * | 4/1964 | Nelson | 187/256 |
| 3,415,343 | A | | 12/1968 | Svensson | |
| 3,420,332 | A | * | 1/1969 | Textor | 182/128 |
| 3,593,823 | A | * | 7/1971 | Thompson | 187/255 |
| 3,780,831 | A | * | 12/1973 | Dickenson | 187/223 |
| 3,866,717 | A | * | 2/1975 | Johansson | 187/270 |

(Continued)

FOREIGN PATENT DOCUMENTS

DE 19744259 7/1998

(Continued)

*Primary Examiner* — Michael R Mansen
*Assistant Examiner* — Stefan Kruer
(74) *Attorney, Agent, or Firm* — Head, Johnson & Kachigian, P.C.

(57) ABSTRACT

A portable elevator climbing system removably attachable to a cantilevered overhang on an adjacent structure, whereby an elevator car travels up and down a plurality of roller chains. The roller chains are engaged with sprockets and guide rollers attached to an axle driven by a motor. The orientation and alignment of the sprockets, guide rollers and roller chains provide for a stable elevator car and for a system free of backlash in both directions. The elevator climbing system includes a dampening assembly to control the rate of decent in the event of transmission, motor or other failure. The elevator climbing system may be controlled so that the start and stop of the motor is coordinated with the release and application of a braking assembly. The efficiency of the elevator climbing system may be varied by adjusting the offset between the sprockets and the guide rollers.

34 Claims, 10 Drawing Sheets

U.S. PATENT DOCUMENTS

| | | | | | |
|---|---|---|---|---|---|
| 3,924,710 | A | | 12/1975 | Shohet | |
| 3,967,703 | A | | 7/1976 | Martin | |
| 4,046,226 | A | | 9/1977 | Flinchbaugh | |
| 4,095,681 | A | | 6/1978 | David | |
| 4,121,693 | A | * | 10/1978 | Fry | 182/131 |
| 4,262,777 | A | | 4/1981 | Christopher | |
| 4,270,628 | A | * | 6/1981 | Anderson | 212/261 |
| 4,317,505 | A | | 3/1982 | Schneider | |
| 4,336,860 | A | * | 6/1982 | Noller et al. | 180/273 |
| 4,351,417 | A | * | 9/1982 | Seiz et al. | 187/373 |
| 4,455,115 | A | * | 6/1984 | Alger et al. | 414/21 |
| 4,520,900 | A | * | 6/1985 | Orgeron | 182/238 |
| 4,650,036 | A | * | 3/1987 | Matsuda | 187/239 |
| 4,658,934 | A | * | 4/1987 | Cooper et al. | 187/253 |
| 4,807,724 | A | | 2/1989 | Martin | |
| 5,191,920 | A | * | 3/1993 | McGregor | 141/313 |
| 5,205,379 | A | * | 4/1993 | Pfleger | 187/253 |
| 5,497,855 | A | * | 3/1996 | Moore | 187/239 |
| 5,499,694 | A | | 3/1996 | Dorn | |
| 5,558,181 | A | | 9/1996 | Bundo | |
| 5,833,216 | A | * | 11/1998 | Husmann | 254/266 |
| 5,904,466 | A | * | 5/1999 | Miller et al. | 414/796.7 |
| 5,906,252 | A | | 5/1999 | Wang | |
| 6,138,799 | A | * | 10/2000 | Schroder-Brumloop et al. | 187/252 |
| 6,361,131 | B1 | * | 3/2002 | Powell, Jr. | 312/312 |
| 6,460,657 | B1 | | 10/2002 | Isenberg et al. | |
| 6,626,265 | B1 | * | 9/2003 | Devine | 182/238 |
| 6,830,132 | B1 | * | 12/2004 | Kang et al. | 187/373 |
| 7,311,179 | B1 | | 12/2007 | Franklin | |
| 7,533,868 | B2 | * | 5/2009 | Cholinski et al. | 254/283 |
| 2006/0151255 | A1 | * | 7/2006 | Payne | 187/351 |

FOREIGN PATENT DOCUMENTS

| | | |
|---|---|---|
| EP | 0117862 | 9/1984 |
| FR | 2439156 | 5/1980 |

* cited by examiner 42
28
4
40
22
20
24
26
34
36
38
64
30
60
32
66
64
4
62
66

FIG. 5
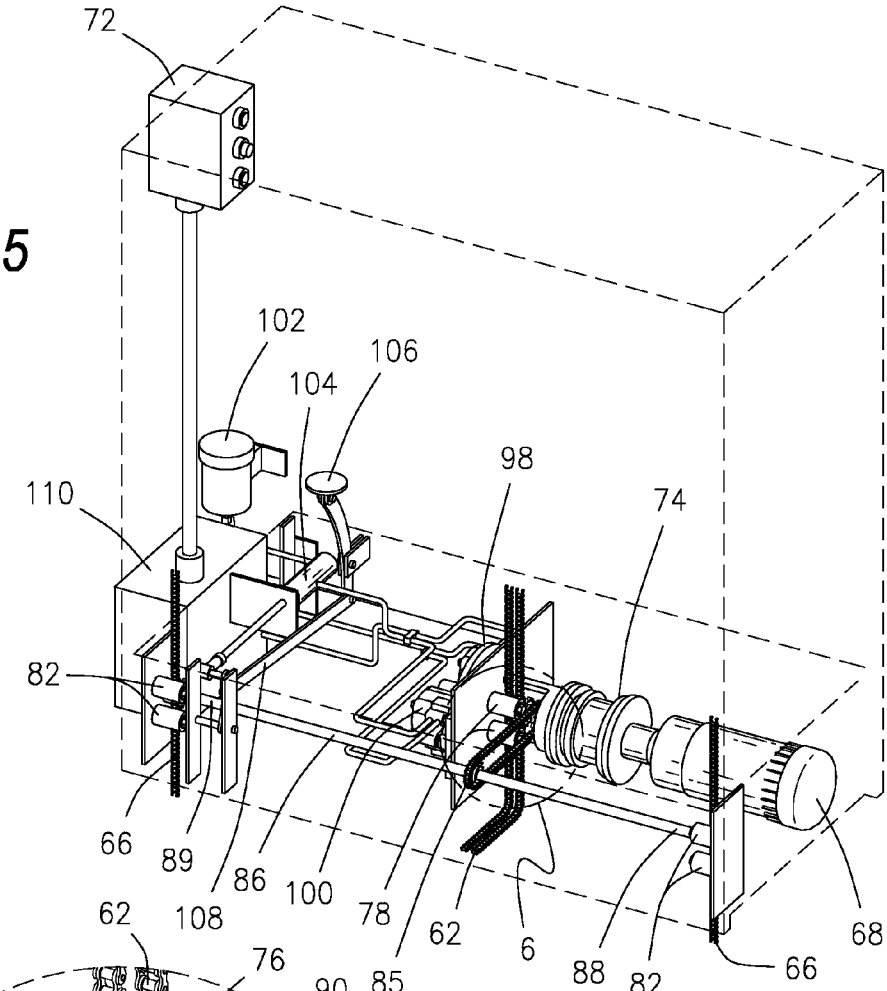
FIG. 6
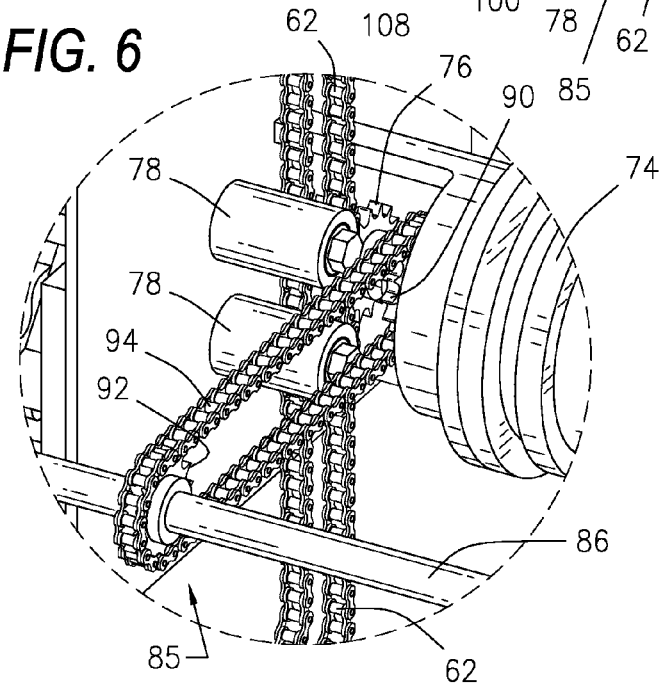
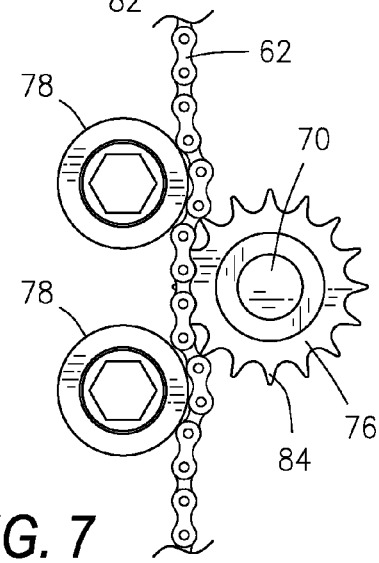
FIG. 7

ELEVATOR CLIMBING SYSTEM

CROSS-REFERENCE TO RELATED APPLICATIONS

This application claims priority to and is a continuation-in-part of U.S. application Ser. No. 10/760,751, filed Jan. 20, 2004, which is incorporated herein by reference.

BACKGROUND OF THE INVENTION

1. Field of the Invention

This invention relates generally to an elevator climbing system, and more particularly concerns a portable elevator climbing system removably attachable to a cantilevered overhang on an adjacent structure, wherein an elevator car travels up and down a plurality of roller chains.

2. Description of the Related Art

Elevators, trams and other devices for transporting items and people up and down steep slopes and vertically through buildings are known. There has always been a danger that, should the device fail, the elevator car or tram would fall a great distance resulting in damage to goods and death to passengers. Several devices have been designed to operate as brakes to stop a rapidly descending car or tram upon failure of the elevator device.

These devices are designed to detect when an elevator car or platform accelerates passed a predetermined speed. The device then rapidly stops the elevator car. This sudden stop jerks whatever is in the car and can cause damage to products and injure passengers. In addition, the car may be stopped at an inconvenient spot. An elevator may be caught between floors and a tram may be stopped only halfway down its track and difficult to get to.

Known elevators also typically use a rack and pinion system, which must be precisely aligned, or may utilize a traction belt, which is adapted to engage a drive pulley. The traction belt must be attached to a hoistway ceiling and be tensioned on the other end by a spring or other tensioning weight. Further, the traction belt is typically engaged to a drive sheath about 180° thus having a total effective wrap angle of about 360° on each side. With this high total effective wrap angle, the traction belt will become increasingly hot, thus, increasing its chance of failure, slippage and breaking. The traction belt suffers from a high wear rate.

Known elevators also typically require counterweights to aid in the lifting a specific load and these counterweight drive system may only be used in straight vertical lifts, allowing only for a finite alignment options. These counterweight drive systems are only usable indoors or in a machine room for an elevator, and may not be utilized in all weather conditions, including but not limited to sleet, rain or snow. If these counterweight drive systems or systems using traction belts are used outside in sleet, rain or snow, acclimate weather would cause the belt to slip and wear, thus, not allowing adequate lifting capacity.

It is therefore desirable to provide a portable elevator climbing system capable of being removably attached to a cantilevered overhang on an adjacent structure.

It is also desirable to provide an elevator climbing system having an elevator car that travels up and down a plurality of roller chains.

It is further desirable to provide an elevator climbing system having roller chains engaged with sprockets and guide rollers, which are attached to an axle driven by a motor.

It is yet further desirable to provide an elevator climbing system wherein the orientation and alignment of the sprockets, guide rollers and roller chains provide for a stable elevator car and for a system free of backlash in both directions.

It is yet further desirable to provide an elevator climbing system having a dampening assembly to control the rate of decent in the event of transmission, motor or other failure.

It is yet further desirable to provide an elevator climbing system that may be controlled so that the start and stop of the motor is coordinated with the release and application of a braking assembly.

It is yet further desirable to provide an elevator climbing system having variable efficiency by adjusting the offset between the sprockets and the guide rollers.

SUMMARY OF THE INVENTION

In general, in a first aspect, the invention relates to an elevator climbing system comprising a motor having an axle, a plurality of roller chains having individually addressable links, a plurality of paired guide rollers, a plurality of sprockets having radially projecting teeth, and a braking assembly coupled to the axle of the motor. A dampening assembly is coupled to the axle of the motor for dampening purposes and emergency descent capabilities. A top section of each of the roller chains is attached to a cantilevered overhang. At least one of the roller chains is a drive chain and at least one of the roller chains is a stabilizer chain. A bottom section of the stabilizer chain is anchored to the ground or a support surface. The guide rollers in each pair of the paired guide rollers are axially spaced and coaxially parallel. The sprockets are offset substantially perpendicularly from the axis of the paired guide rollers, respectively. The paired guide rollers cause the roller chain to firmly engage the respective sprocket. At least one of the sprockets is a drive sprocket attached to the axle and another of the sprockets is a stabilizer sprocket connected via a linkage to the drive sprocket.

The motor may be electric, hydraulic or other rotating power supply. The elevator climbing system may include a transmission coupled to the motor and the axle.

The linkage may include a first linking sprocket attached to the axle of the motor, a second linking sprocket attached to a second axle having opposing ends, and a linking chain forming a loop and engaged with the first and second linking sprockets. The stabilizer sprockets may be attached to each opposing end of the second axle such that the drive sprocket and the stabilizer sprockets are driven at substantially equivalent rates. The drive sprocket and the stabilizer sprockets may be aligned in a substantially triangular orientation to stabilize the elevator climbing system.

The braking assembly may include a rotor attached to the axle and at least one caliper. The caliper may include brake pads activated by spring pressure. The caliper may be in fluid communication with a brake fluid reservoir and an actuator. The caliper may further include at least one spring that causes the brake pads to engage the rotor upon a predetermined decrease in pressure in the braking assembly. The spring may be a Bellevue washer. A depressible brake release pedal may be connected in communication with the actuator, such that depression of the brake release pedal causes actuation of the actuator resulting in increased pressure in the braking assembly, which in turn causes the spring to disengage the brake pads from the rotor. At least one limit switch may also be attached to at least one of the roller chains. Activation of the limit switch opens a valve on the calipers for a predetermined time releasing brake fluid from the caliper directly to the brake fluid reservoir resulting in decreased pressure and causing the spring to engage the brake pads with the rotor.

The elevator climbing system may further comprise an adjustable diaphragm pressure switch in fluid communication with the braking assembly. The pressure switch monitors the pressure of the braking assembly and causes the motor to start or stop at predetermined pressure points.

The dampening assembly may be a closed loop hydraulic dampening system. The dampening assembly can also include a hydraulic fluid reservoir in fluid communication with a dampening motor, an adjustable relief valve in fluid communication with the dampening motor and the hydraulic fluid reservoir, a check valve in fluid communication with the dampening motor and the hydraulic fluid reservoir, and hydraulic fluid in the hydraulic fluid reservoir and the dampening motor. The dampening motor can be a low speed, high torque motor.

The cantilevered overhang may be a self-contained, portable cantilevered bracket assembly. The cantilevered bracket assembly may include a pair of substantially vertical, triangular support members aligned in parallel and a substantially horizontal support bar having opposing ends attached to the triangular support members. The triangular support members may include at least one latch allowing the cantilevered bracket assembly to be removably securable to an adjacent structure. The roller chains may be attached to the cantilevered bracket assembly. The adjacent structure may be an oil derrick, a building, a water tower, a TV or radio tower, a ship or other structure requiring the elevator climbing system. The cantilevered bracket assembly provides for proper alignment between the sprockets and the respective roller chains.

The elevator climbing system may have an elevator car with a safety cage and at least one gate pivotally secured to the cage. The elevator car would travel up and down the roller chains. The elevator climbing system may be portable.

In general, in a second aspect, the invention relates to a portable, self-contained elevator climbing system removably attachable to an adjacent structure. The elevator climbing system includes a motor having a primary axle and a closed loop hydraulic dampening assembly coupled to the primary axle. The motor may be electric, hydraulic or other rotating power supply. A transmission coupled to the motor and the primary axle. A braking assembly is coupled to the primary axle. The braking assembly includes at least one disc brake having a caliper engagable with a rotor attached to the primary axle in response to a decrease in hydraulic pressure in the braking assembly. An adjustable diaphragm pressure switch is in fluid communication with the braking assembly. The pressure switch monitors the hydraulic pressure of the braking assembly and causes the motor to start or stop at predetermined pressure points. The elevator climbing system also includes a plurality of roller chains having individually addressable links. At least one of the roller chains is a drive chain, and at least two of the roller chains are stabilizer chains. A bottom section of the stabilizer chains is anchored to the ground or a support surface. A plurality of paired guide rollers is further provided, with the guide rollers in each pair being axially spaced and coaxially parallel. A plurality of sprockets having radially projecting teeth is offset substantially perpendicularly from the axis of the paired guide rollers. The paired guide rollers cause the roller chain to firmly engage the sprocket respectively. At least one of the sprockets is a drive sprocket attached to the primary axle, while at least two of the sprockets are stabilizer sprockets connected via a linkage to the drive sprocket. The drive sprocket and the stabilizer sprockets are aligned in a substantially triangular orientation to stabilize the elevator climbing system. The linkage has a first linking sprocket attached to the primary axle, a second linking sprocket attached to a secondary axle having opposing ends and a linking chain forming a loop and engaged with the first and second linking sprockets. The stabilizer sprockets are attached to each opposing end of the secondary axle such that the drive sprocket and the stabilizer sprockets are driven at substantially equivalent rates. The primary axle and the secondary axle are substantially parallel. A cantilevered bracket assembly is removably securable to the adjacent structure and each of the roller chains is attached to the cantilevered bracket assembly. The cantilevered bracket assembly provides proper alignment between the sprockets and the respective roller chains. An elevator platform is further provided and is capable of traveling up and down the roller chains.

The caliper may include at least one spring, which causes the caliper to engage the rotor upon a predetermined decrease in hydraulic pressure in the braking assembly. The spring may be a Bellevue washer. A depressible brake release pedal may be connected in communication with an actuator, wherein depression of the brake release pedal causes actuation of the actuator resulting in increased hydraulic pressure in the braking assembly. This increased hydraulic pressure causes the spring to disengage the brake pads from the rotor. At least one limit switch may be attached to at least one of the roller chains. Activation of the limit switch opens a hydraulic valve on the caliper for a predetermined time releasing brake fluid from the caliper directly to a brake fluid reservoir resulting in decreased hydraulic pressure and causing the spring to engage the brake pads to the rotor.

The hydraulic dampening assembly may include a hydraulic fluid reservoir in fluid communication with a dampening motor, an adjustable relief valve in fluid communication with the dampening motor and the hydraulic fluid reservoir, a check valve in fluid communication with the dampening motor and the hydraulic fluid reservoir, and hydraulic fluid in the hydraulic fluid reservoir and the dampening motor. The dampening motor may be a low speed, high torque motor.

The cantilevered bracket assembly may include a pair of substantially vertical, triangular support members aligned in parallel and a substantially horizontal support bar having opposing ends attached to the triangular support members. The triangular support members may have at least one latch to removably secure the cantilevered bracket assembly to the adjacent structure.

BRIEF DESCRIPTION OF THE DRAWINGS

FIG. 5 is a perspective, schematic view of an example of the elevator climbing system in accordance with an illustrative embodiment of the elevator climbing system of FIGS. 1 and 2;

FIG. 6 is an exploded perspective view of area 6 of the elevator climbing system shown in FIG. 5;

FIG. 7 is a schematic side view of an example of the sprocket, guide rollers and roller chain in accordance with an illustrative embodiment of the elevator climbing system;

Other advantages and features will be apparent from the following description, and from the claims.

DETAILED DESCRIPTION OF THE PREFERRED EMBODIMENTS

The devices discussed herein are merely illustrative of specific manners in which to make and use this invention and are not to be interpreted as limiting in scope.

While the devices have been described with a certain degree of particularity, it is to be noted that many modifications may be made in the details of the construction and the arrangement of the devices and components without departing from the spirit and scope of this disclosure. It is understood that the devices are not limited to the embodiments set forth herein for purposes of exemplification.

Figure 1:
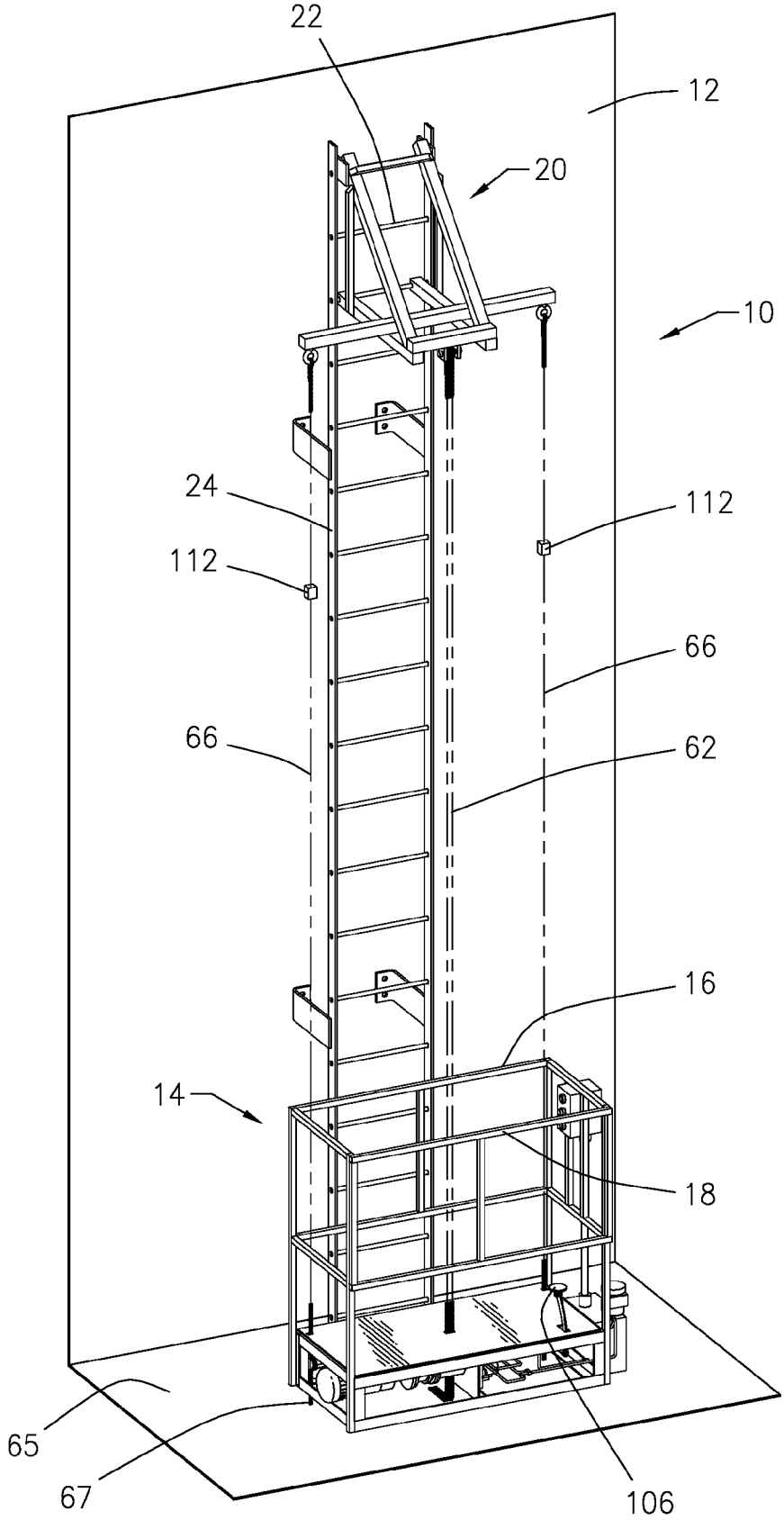
FIG. 1 is a perspective view of an example of an elevator climbing system in accordance with an illustrative embodiment of the elevator climbing system disclosed herein.
Figure 2:
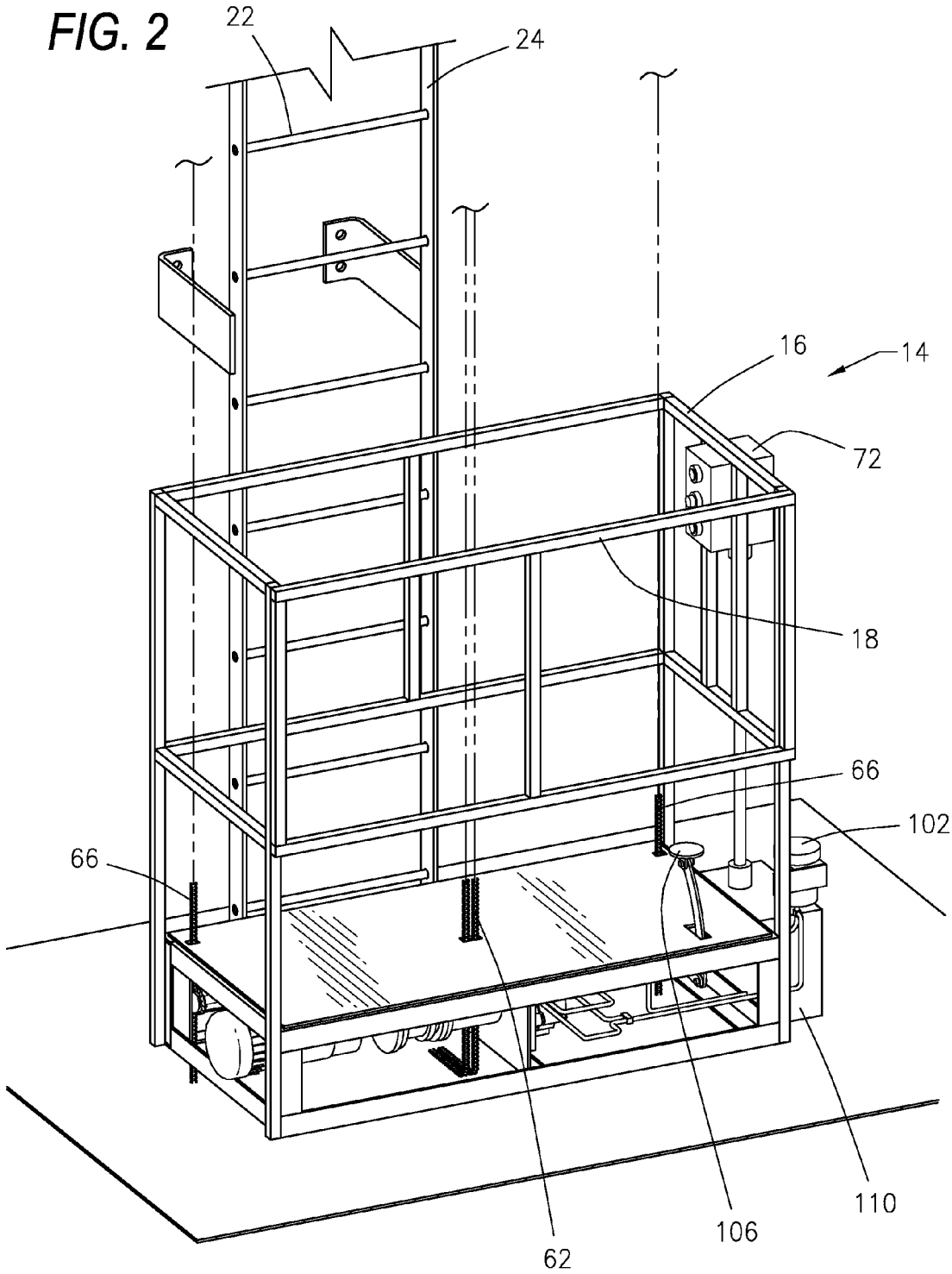
FIG. 2 is an enlarged partial view of an example of an elevator car in accordance with an illustrative embodiment of the elevator climbing system of FIG. 1.
Figure 3:
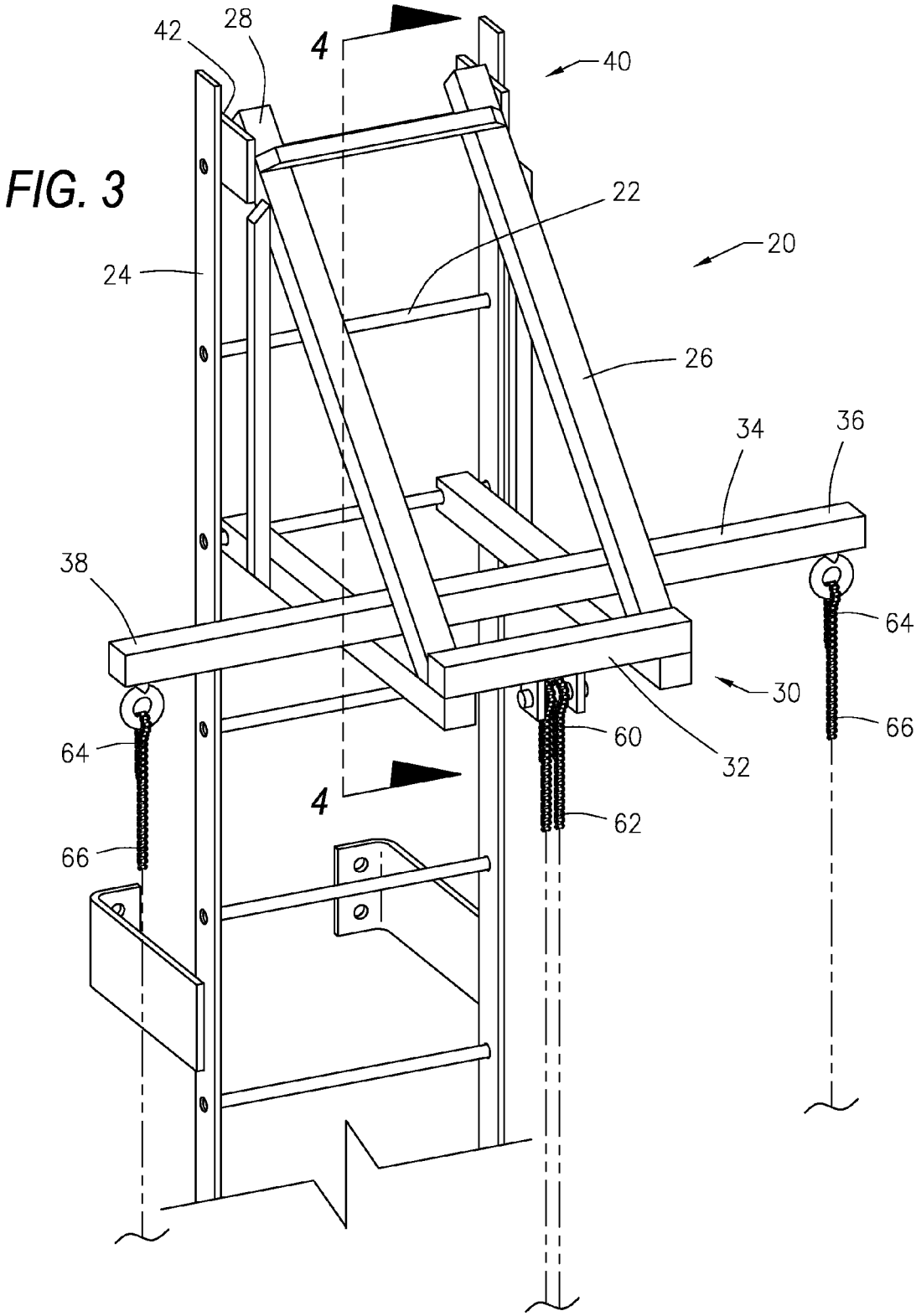
FIG. 3 is an enlarged partial view of an example of the cantilevered bracket assembly in accordance with an illustrative embodiment of the elevator climbing system of FIG. 1.
Figure 4:
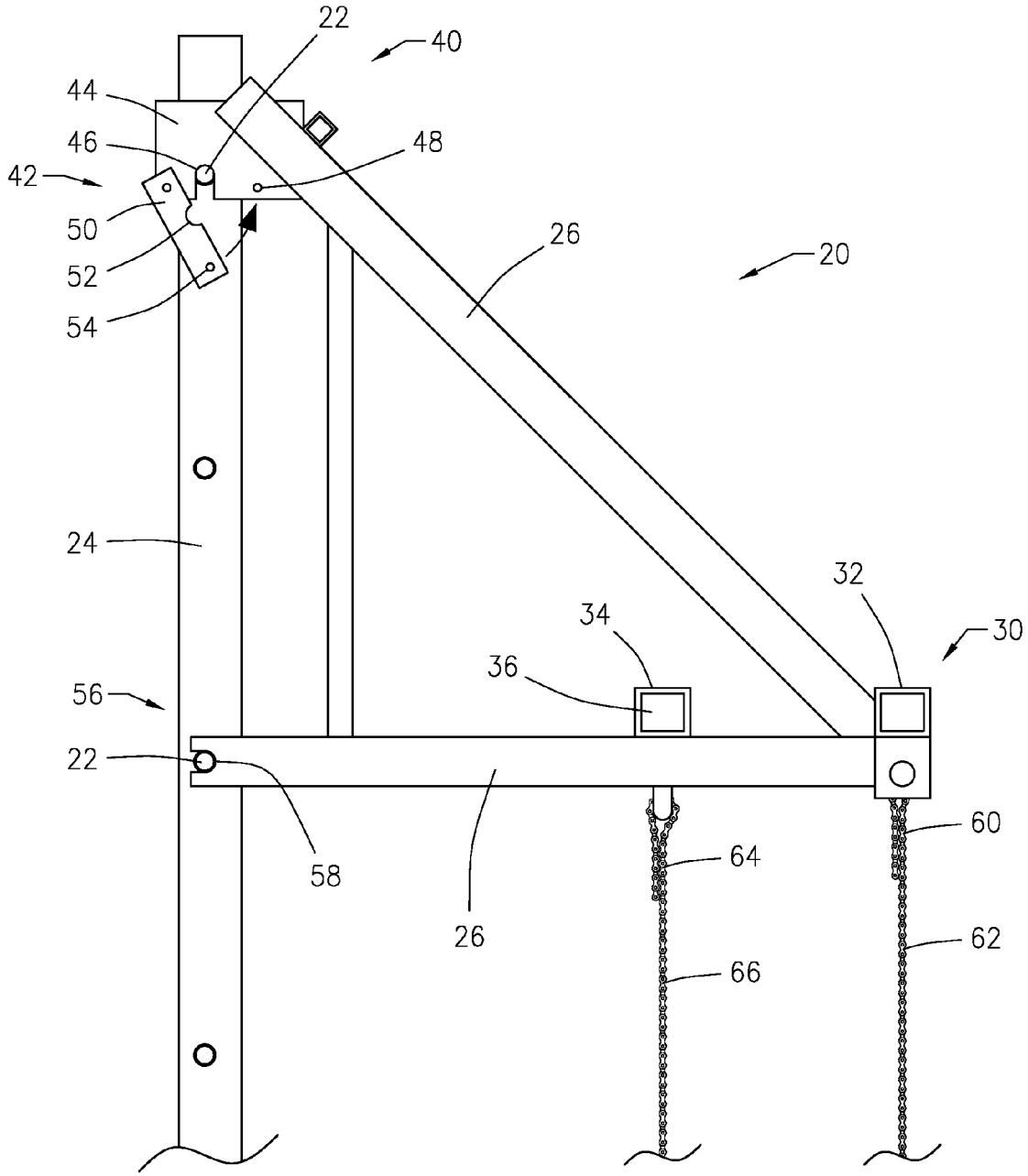
FIG. 4 is a cross-sectional view along line 4-4 of the cantilevered bracket assembly of the elevator climbing system shown in FIG. 3.
Figure 8:
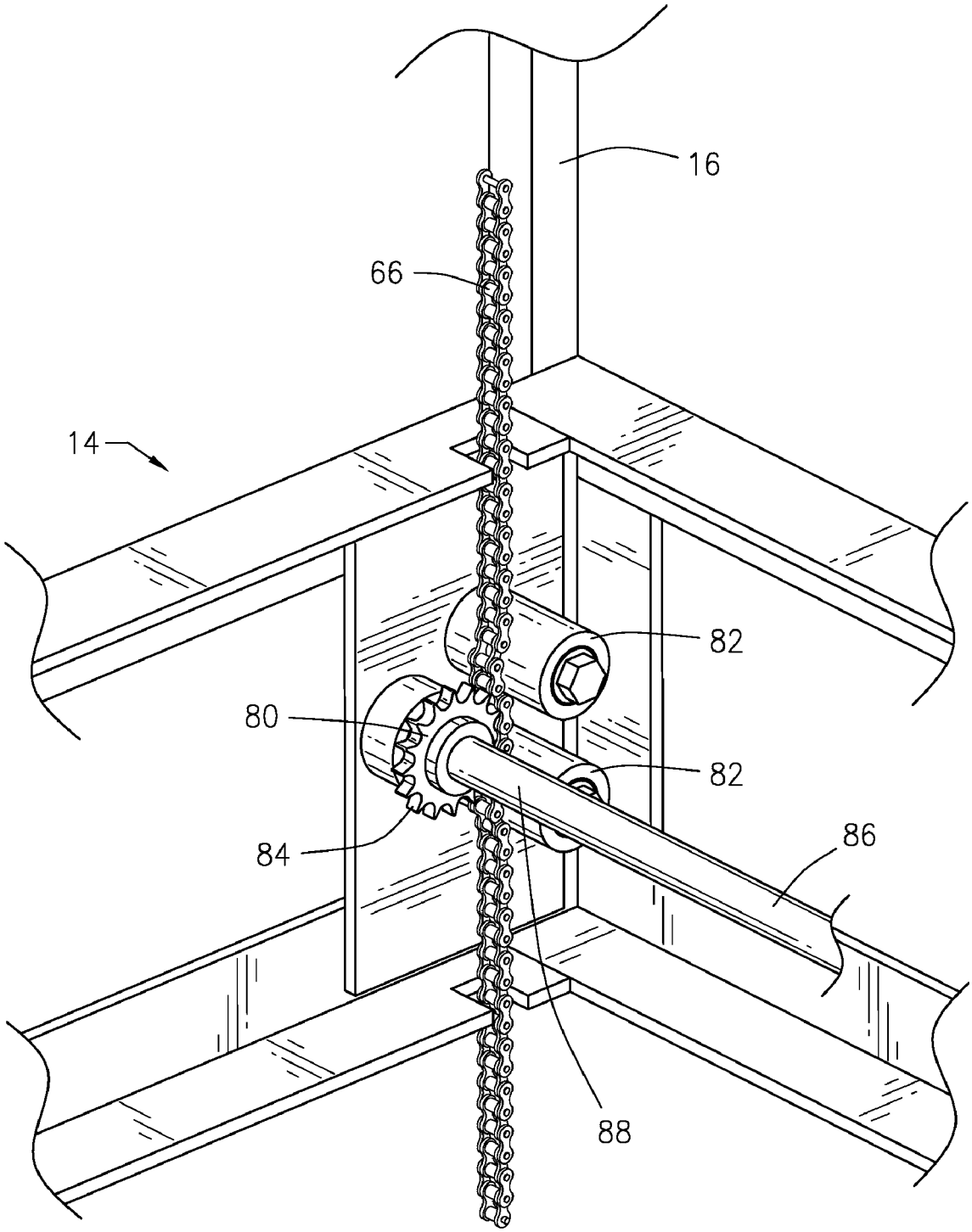
FIG. 8 is an enlarged partial view of an example of the stabilizer sprocket, stabilizer guide rollers and stabilizer chain in accordance with an illustrative embodiment of the elevator climbing system.
Figure 9:
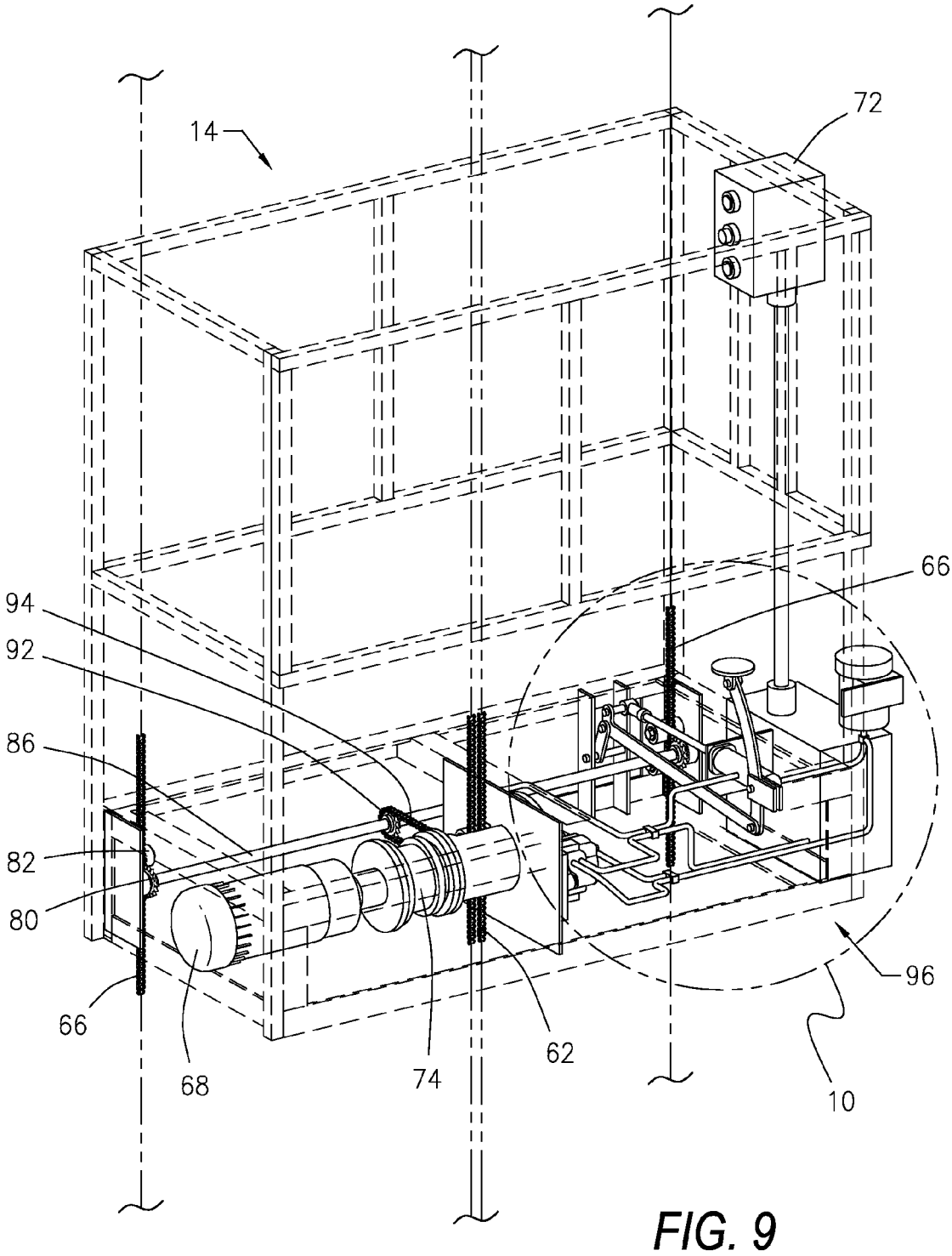
FIG. 9 is a perspective, schematic view an example of the elevator climbing system in accordance with the illustrative embodiment of FIGS. 1 and 2.
Figure 10:
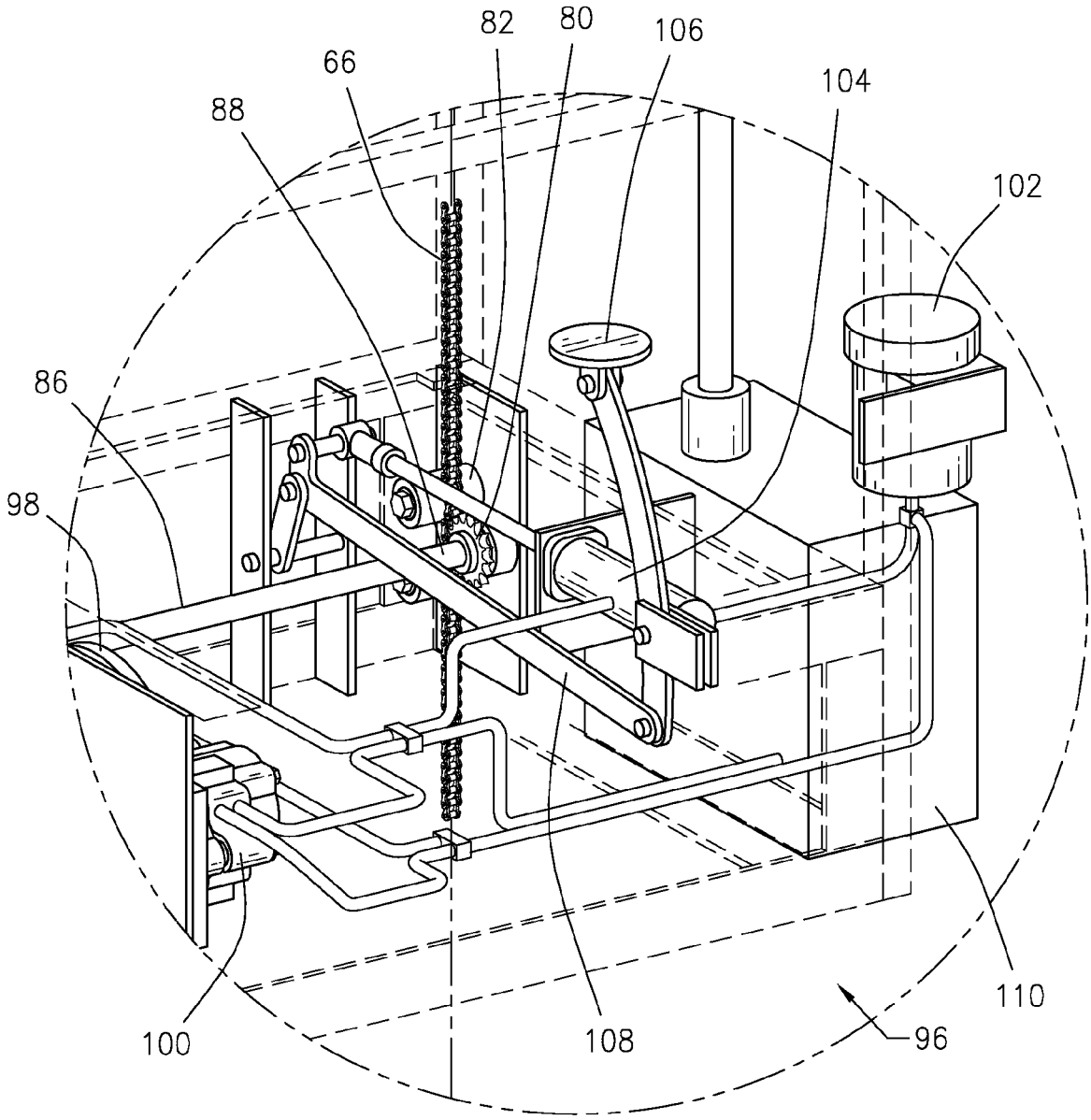
FIG. 10 is an exploded perspective view of area 10 of the elevator climbing system shown in FIG. 9.
Figure 11:
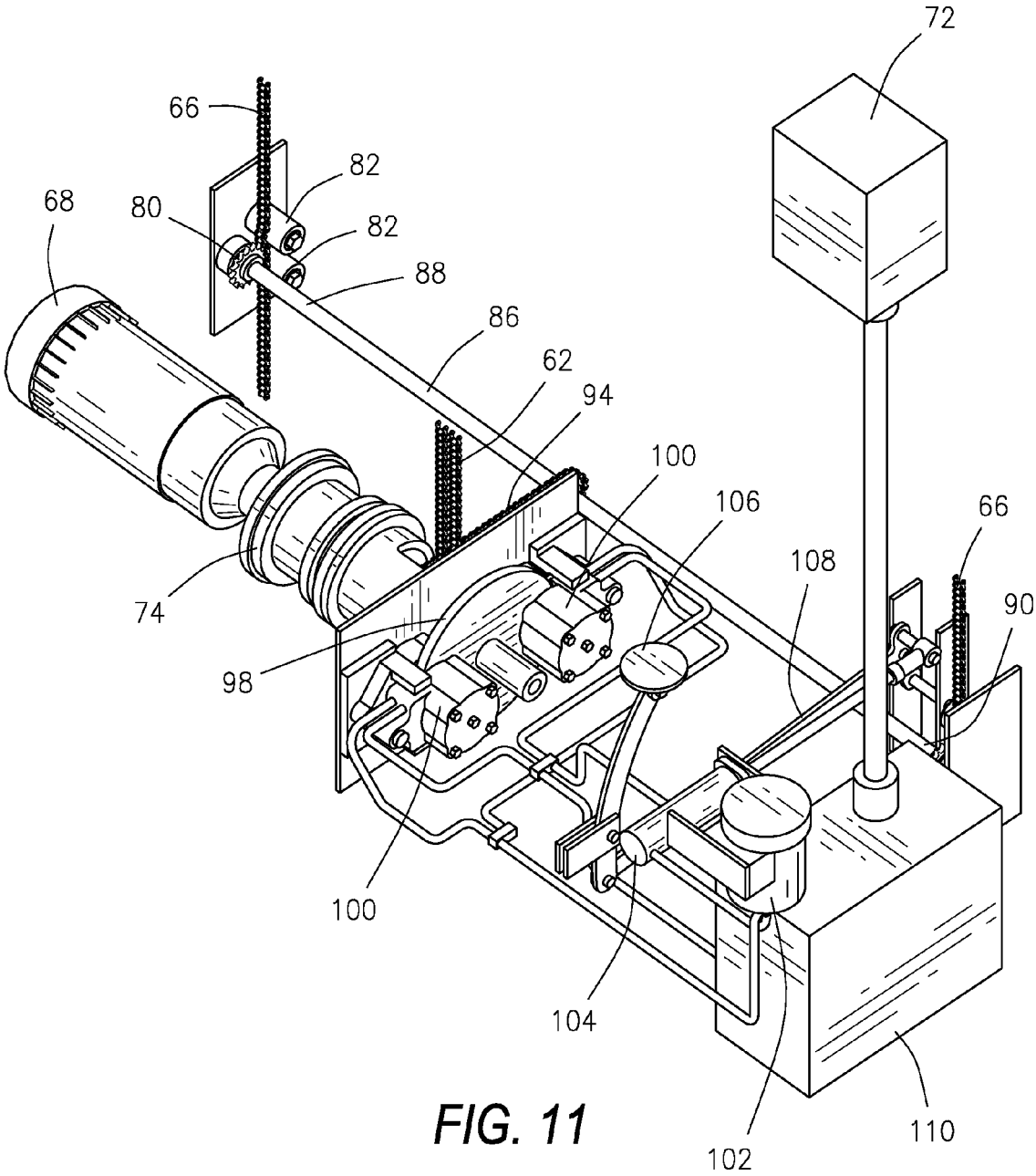
FIG. 11 is a perspective, schematic view of an example of the drive assembly and the braking assembly in accordance with an illustrative embodiment of the elevator climbing system.
Figure 12:
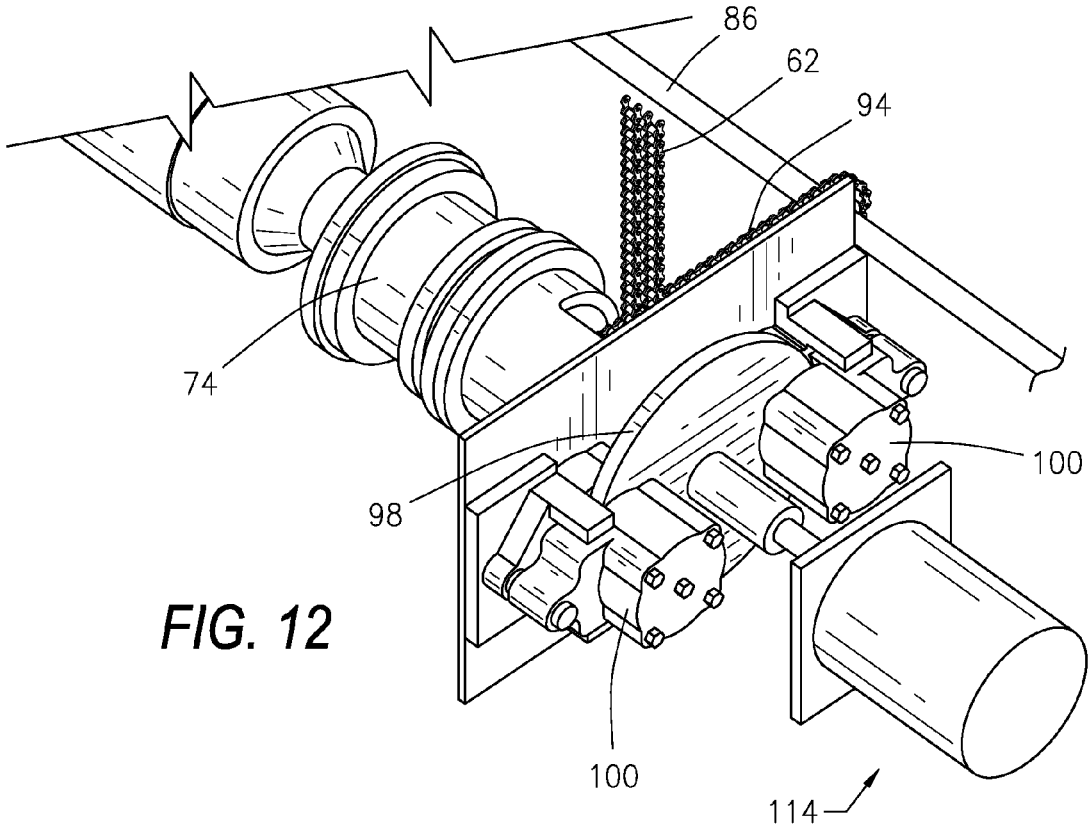
FIG. 12 is an enlarged partial view of an example of the dampening assembly and the braking assembly in accordance with an illustrative embodiment of the elevator climbing system.
Figure 13:
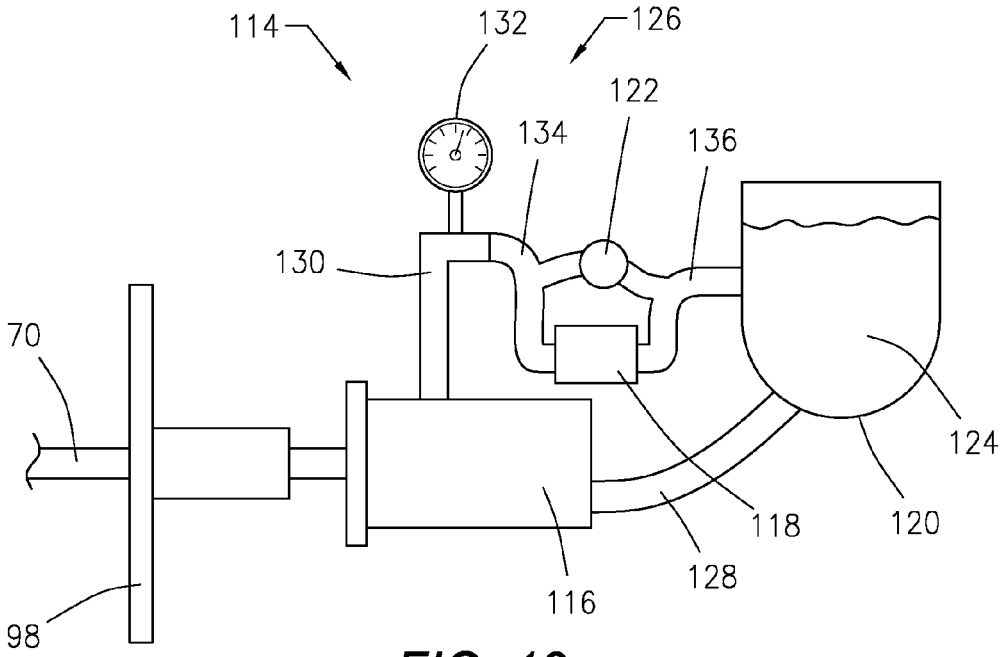
FIG. 13 is a diagrammatic side view of an example of the dampening assembly in accordance with an illustrative embodiment of the elevator climbing system.

Referring to the figures of the drawings, wherein like numerals of reference designate like elements throughout the several views, and initially to FIG. 1, an elevator climbing system 10 that is self-contained and portable, and which is removably securable to a cantilevered overhang on an adjacent structure 12. The elevator climbing system 10 may include an elevator car or platform 14. The elevator car 14 may include a safety cage 16 and at least one gate 18 pivotally secured to the safety cage 16. A hydraulic dampening system, a braking assembly and a driving assembly may be attached directly to the elevator car 14. Those skilled in the art will appreciate that although the Figures show the forgoing attached to the bottom of the elevator car 14, they may also be attached to the top of the elevator car 14 or may be completely detached from the elevator car 14.

A self-contained cantilevered bracket 20 may also be included and is removably securable to the adjacent structure 12. As shown in the Figures, the cantilevered bracket 20 is removably attached to a rung 22 of a ladder 24 on an oil derrick (not shown). Those skilled in the art will appreciate that the cantilevered bracket 20 could be attached to adjacent structures 12 other than a ladder, such as the side or a top of a building, a TV/radio tower, a water tower, an oil derrick, the haul of a ship or some other structure that requires the use of an elevator climbing system 10. The cantilevered bracket 20 should attach to the adjacent structure 12 above the desired stop location of the elevator car 14. The cantilevered bracket 20 includes a latching assembly allowing easy installation and removal of the elevator climbing system 10 on the ladder 24. The cantilevered bracket 20 is self-contained and portable and allows the elevator climbing system 10 to be transported to the next job site.

The cantilevered bracket 20 may include a pair of substantially vertical, triangular support members 26 and 28, which are aligned in parallel. An outer apex 30 of the support members 26 and 28 are joined using a horizontal support member 32. A substantially horizontal support bar 34 having opposing ends 36 and 38 may be attached to the vertical support members 26 and 28. The horizontal support bar 34 is offset from and parallel to the horizontal support member 32. A top apex 40 of the vertical support members 26 and 28 may include a latching assembly to removably secure the cantilevered bracket 20 to the adjacent structure 12. The latching assembly may include a latch 42 attached to the top apex 40 of the vertical support members 26. As shown in the Figures, the latches 42 are releasably engagable with the rung 22 of the ladder 24 the oil derrick (not shown). The latches 42 may include an upper latch plate 44 having a groove 46 for receipt of the ladder rung 22 and a lock hole 48. A lower latch plate 50 has a corresponding groove 52 to receive the bottom portion of the ladder rung 22. The lower latch plate 50 also includes a locking hole 54. The lower latch plate 50 is pivotally secured to the upper latch plate 44. A locking pin (not shown) may be inserted through the locking hole 48 in the upper latch plate 44 and the locking hole 54 in the lower latch plate 50 to releasably secure the cantilevered bracket 20 to the adjacent structure 12. A bottom apex 56 of the vertical support members 26 and 28 may include a groove 58 to receive and abut a lower rung 22 on the ladder 24. A top section 60 of at least one drive chain 62 may be attached to the horizontal support member 32, while top sections 64 of stabilizer chains 66 may be attached to respective opposing ends 36 and 38 of the support bar 34. The drive chain 62 is only required to be secured to the cantilevered bracket 20 above the elevator platform 14, thus allowing the drive chain 62 to hang freely from the cantilevered bracket 20. Bottom sections 67 of the stabilizer chains 66 are anchored to the ground or a support surface 65 to prevent swaying and tilting of the elevator car or platform 14. The elevator car 14 may be lowered to the ground or support structure 65, and the drive chain 62, the stabilizer chains 66 and the cantilevered bracket 20 may be lowered such that the roller chains 62 and 66 lay on or within the elevator car 14, allowing the elevator climbing system 10 to be compact and transportable. The cantilevered bracket 20 ensures proper alignment between the roller chains 62 and 66 so that substantially vertical roller chain alignment may be maintained.

The elevator climbing system 10 is driven by a motor 68, which may be electric, hydraulic or other rotating power supply, having an axle 70. The motor 68 may be in communication with a control box 72 attached to the elevator car 14 having an up, down and stop button. A transmission 74 may be coupled to the axle 70 of the motor 68. At least one drive sprocket 76 is attached to the axle 70 of the motor 68, with a drive guide rollers 78 offset and engaged with the drive chain 62. The drive guide rollers 78 cause the drive chain 62 to be firmly engaged and seated into the pitch diameter of the drive sprocket 76, thus not allowing the drive chain 62 to escape the driving effect of the drive sprocket 76. The elevator climbing system 10 also includes one or more stabilizer sprockets 80 and stabilizer guide rollers 82, wherein the stabilizer guide rollers 82 cause the stabilizer chains 66 to be firmly engaged and seated into the pitch diameter of the stabilizer sprockets 80, respectively.

The drive and stabilizer guide rollers 78 and 82 each comprise a set of paired guide rollers being axially spaced and coaxially parallel. The drive and stabilizer sprockets 76 and 80 have radially projecting teeth 84, with each sprocket 76 and 80 being offset from the respective guide rollers 78 and 82 in a substantially perpendicular orientation. The drive sprocket 76 and the stabilizer sprockets 80 have the same number of radially projecting teeth 84 and are coupled with and driven at the same RPM. The sprockets 76 and 80 may be offset from the respective paired guide rollers 78 and 82 by ⅝ inch or less. The variation in the amount of offset between the sprockets 76 and 80 and the paired guide rollers 78 and 82 allows for a variable efficiency. By increasing the offset between the sprockets 76 and 80 and the paired guide rollers 78 and 82, the elevator climbing system 10 becomes less efficient, which may be desirable when a dampening action is desired when a load is raised or lowered. For maximum efficiency, the offset should be kept at a minimum. This minimal offset between the sprockets 76 and 80 and the paired guide rollers 78 and 82 results in a much longer life to the drive chain 62 and the stabilizer chains 66 and allows the elevator climbing system 10 to be ran at high speeds without the roller chains 62 and 66 becoming hot, thus, decreasing the chance that the elevator climbing system 10 having a failure, slippage and break. Further, the elevator climbing system 10 has infinite alignment options without any binding issues since the roller chains 62 and 66 do not have to be precisely aligned.

The drive chain 62 and the stabilizer chains 66 are under constant tension, creating zero backlash in both up and down directions between the sprockets 76 and 80 and the guide rollers 78 and 82. Since the sprockets 76 and 80 typically have at least two teeth 84 engaged with the roller chains 62 and 66 and due to the offset of the guide rollers 78 and 82 from the sprockets 76 and 80, the elevator climbing system 10 is backlash free in both the up and down directions. With the minimal amount of offset, the elevator climbing system 10 provides a high efficiency, backlash free system that could be used for other applications requiring these capabilities. Since the roller chains 62 and 66 are flexible, the elevator climbing system 10 works well in unsupported systems, unlike rigid rack and pinion systems that require rigid mounting and precision alignment for the rack gear and pinion gear. The elevator climbing system 10 may operate horizontally or vertically, does not require counterweights to aid in the lifting a specific load, does not need to be anchored by a spring tensioning weight and may be utilized in all weather conditions, including but not limited to sleet, rain or snow.

The drive sprocket 76 is linked to the stabilizer sprockets 80 via a linkage 85 and may be aligned in a substantially triangular orientation to stabilize the elevator climbing system 10. The linkage 86 may include a second axle 86 having opposing ends 88 and 89, with each of the opposing ends 88 and 89 having stabilizer sprockets 80 attached thereto. The axle 70 of the motor 68 may include a first linkage sprocket 90, while the second axle 86 may include a second linkage sprocket 92. A looped linking chain 94 engages the first and second linkage sprocket 90 and 92, thus causing the drive sprocket 76 and the stabilizer sprockets 80 to be driven at substantially equivalent rates. The axle 70 of the motor 68 is offset from and aligned in parallel with the second axle 86. This triangular orientation between the drive sprocket 76 and the stabilizer sprockets 80 create an extremely stable and powerful elevator climbing system 10. Additionally, this triangular orientation, along with the minimal offset between the guide rollers 78 and 82 and the sprockets 76 and 80 gives unlimited horsepower capabilities and increased torque capabilities and allows the elevator platform 14 to carry a much greater amount of weight during operation. As the elevator car 14 of the elevator climbing system 10 moves up and down, the drive chain 62, the drive sprocket 76 and the drive guide rollers 78 along with the stabilizer chains 66, the stabilizer sprockets 80 and the stabilizer guide rollers 82, which are placed outboard of the drive chain 62, form a triangle of support, stabilizing the elevator climbing system 10 by not letting the system tilt in any direction since the stabilizer chains 66 support the elevator climbing system 10 the same as the drive chain 62, thus preventing the elevator car 14 from tilting in any direction. The stabilizer chains 66 also contribute in powering the elevator climbing system 10 and share the lifting load with the drive chain 62. The elevator climbing system 10 moves up and down the roller chain 62 and 66. The elevator climbing system 10 is self-contained with its own prime mover for driving the drive sprocket 76 and the stabilizer sprockets 80.

The elevator climbing system 10 includes a braking assembly 96 for stopping and a hydraulic dampening assembly 114 coupled to the axle 70 of the motor 68 for dampening purposes and emergency descent capabilities.

The braking assembly 96 is coupled to the axle 70 of the motor 68 and may include a pair of disc brakes. A rotor 98 is coupled to the axle 70 and may be engaged by at least one disc brake caliper 100. The caliper 100 has brake pads (not shown) activated by spring pressure in the braking assembly 96 and engage the rotor 98 to stop the elevator climbing system 10. The caliper 100 may include springs (not shown) that are responsive to hydraulic pressure in the braking assembly. The springs may be Bellevue washers to provide high accuracy. The caliper 100 is in fluid communication with a brake fluid reservoir 102 containing brake fluid (not shown) and an actuating piston 104. Upon a decrease in hydraulic pressure in the braking assembly 96, the springs in the caliper 100 cause the brake pads to engage the rotor 98 causing the elevator car 14 to stop, while upon an increase in hydraulic pressure in the braking assembly 96, the springs in the calipers 100 cause the brake pads to disengage the rotor 98 allowing the elevator car 14 to travel along the roller chains 62 and 66.

The braking assembly 96 may further include a brake release pedal 106 pivotally linked using an arm 108 in communication with the actuating piston 104. The brake release pedal 106 is depressible by a user (not shown). The depression of the brake release pedal 106 causes the piston 104 to actuate resulting in increased hydraulic pressure in the braking assembly 96. This increased hydraulic pressure is transmitted to the spring in the calipers 100 causing the brake pads to disengage the rotor 98, thus allowing the elevator car 14 to move along the roller chains 62 and 66. An adjustable diaphragm pressure switch 110 may also be in fluid communication with the braking assembly 96 and in communication with the motor 68. The pressure switch 110 monitors the hydraulic pressure in the braking assembly 96 and at predetermined hydraulic pressure points, causes the motor 68 to start or stop. The pressure switch 110 allows the elevator climbing system 10 to be controlled so that the start and stop of the motor 68 is coordinated with the release and application of the braking release pedal 106.

The elevator climbing system 10 may also include at least one limit switch 112 attached to at least one of the roller chains 62 and 66. The limit switch 112 is in communication with braking assembly 96. The elevator climbing system 10 may include an upper and lower limit switch attached along the roller chains 62 and 66. If the elevator car 14 traveling along the roller chains 62 and 66 passes the limit switch 112, the limit switch 112 is activated causing a hydraulic valve (not shown) on the caliper 100 to open for a predetermined period of time allowing the brake fluid in the caliper 100 to release directly to the brake fluid reservoir 102. This sudden decrease in hydraulic pressure in the caliper 100 causes the spring to engage the brake pads, which in turn engage the rotor 98 of the braking assembly 96 to stop the elevator car 14. Further, if the stop button in the control box 72 is activated while the elevator car 14 is traveling along the roller chains 62 and 66, the hydraulic valve in the caliper 100 will open for a predetermined period of time causing the brake fluid in the caliper 100 to release directly to the brake fluid reservoir 102 and cause the brake pads to engage the rotor 98 to stop the elevator car 14. In order to continue travel, the user must activate the up or down buttons of the control box 72. The elevator car 14 will continue its course of travel if the user activates the up button of the control box 72 while the elevator car 14 is traveling in a downward direction or if the user activates the down button of the control box 72 while the elevator car 14 is traveling in an upward direction. The stop button of the control box 72 should be activated prior to changing the direction of travel.

The hydraulic dampening assembly 114 may be a closed loop hydraulic system and may include a low speed, high torque hydraulic pump 116 coupled to and driven by the axle 70 of the motor 68. The hydraulic pump 116 produces instantaneous pressure and instantaneous slow down when the elevator car 14 is traveling in a downward direction. The hydraulic pressure in the dampening assembly 114 may be controlled by a relief valve 118 that provides restrictive torque to the descending load, thus controlling the rate of descent of the elevator car 14. The dampening assembly 114 includes a hydraulic reservoir 120 in fluid communication with the hydraulic pump 116. When the elevator car 14 is driven in upward direction, a check valve 122 provides free flow to the pump 116 so that very little power is consumed by the dampening assembly 114. The dampening assembly 114 provides a safe descent rate in the event of driving power failure or in the event that the braking assembly 96 should fail. The dampening assembly 114 would also control descent in the event of transmission failure.

Hydraulic fluid 124 in the dampening assembly 114 is fed to the hydraulic pump 116 by assembly 126 and tube 128. Assembly 126 and tube 128 connect to the hydraulic reservoir 120 containing hydraulic fluid 124. Assembly 126 may be comprised of pipe 130, pressure gauge 132, tubing 134, check valve 122, relief valve 118 and tubing 136. Check valve 122 only allows flow of a fluid in one direction, and as shown in the Figures, check valve 122 allows hydraulic fluid 124 to flow through it from hydraulic reservoir 120 to the hydraulic pump 116 through tubes 134 and 136 and pipe 130. It does not allow the hydraulic fluid 124 to flow in the opposite direction. Relief valve 118 allows the hydraulic fluid 124 to flow through it in one direction only. However, relief valve 118 allows flow only at a very slow rate. This rate may be adjusted. When the hydraulic fluid 124 flows from the hydraulic reservoir 120 through tubing 130 and the check valve 122 through tubing 134, pipe 130 and into the hydraulic pump 116, the hydraulic fluid 124 flows relatively easily and allows the axle 70 coupled to the hydraulic pump 116 to spin freely and rapidly. Hydraulic fluid 124 travels through tube 128 and back into the hydraulic reservoir 120. When fluid flows in the opposite direction, check valve 122 closes and the hydraulic fluid 124 may only flow through the relief valve 118. Relief valve 118 restricts the flow rate by a pre-determined amount. As the drive sprocket 76 turns while descending the roller chains 62 and 66, the axle 70 rotates so that the hydraulic fluid 124 gets pumped through tube 128 and the hydraulic pump 116 and forced into pipe 130 and tube 134. Because relief valve 118 only allows flow at a very slow rate, pressure builds in the dampening assembly 114 and assembly 126 and may be measured by pressure gauge 132. This slows the rate by which the axle 70 may turn and allows the elevator car 14 to only descend slowly. It may also be desirable to have the relief valve 118 attached to controls which may be actuated from within the elevator car 14 such that the speed of descent may be adjusted. Pressure gauge 132 may be included to monitor the hydraulic pressure that builds in the dampening assembly 114 when the elevator car 14 descends. Operators of the elevator climbing system 10 may use the pressure gauge 132 to verify that the dampening assembly 114 is operating properly. The use of the check valve builds up pressure within the hydraulic motor and limits the rate of descent. Should the braking assembly 96 or transmission 74 fail in some manner, the rate of descent of the elevator car 14 remains controlled by the check valve 122 and the pressure build up in hydraulic pump 116. This dual safety system comprised of both the dampening assembly 114 having a controlled rotation rate, along with the braking assembly 96 provide for a very safe elevator climbing system 10.

Whereas, the devices and methods have been described in relation to the drawings and claims, it should be understood that other and further modifications, apart from those shown or suggested herein, may be made within the spirit and scope of this invention.

What is claimed is:

1. An elevator climbing system, comprising:

a plurality of stationary roller chains having individually addressable links, wherein at least one of said roller chains is a drive chain, wherein at least one of said roller chains is a stabilizer chain, wherein said stationary roller chains are substantially linear, and wherein opposing end sections of at least one of said stationary, substantially linear roller chains is constructed to anchored to an adjacent surface or structure; and a platform constructed to traverse said stationary, substantially liner roller chains, said platform further comprising:

a motor having an axle;

a plurality of paired guide rollers, said guide rollers in each of said pairs being axially spaced and coaxially parallel;

a plurality of sprockets having radially projecting teeth, each of said sprockets being offset substantially perpendicularly from said axis of said paired guide rollers, wherein said paired guide rollers cause said roller chain to firmly engage said sprocket respectively, wherein at least one of said sprockets is a drive sprocket attached to said axle, wherein at least one of said sprockets is a stabilizer sprocket connected via a linkage to said drive sprocket, wherein said linkage includes a first linking sprocket attached to said axle of said motor, a second linking sprocket attached to a second axle having opposing ends and a linking chain forming a loop and engaged with said first and second linking sprockets, said stabilizer sprockets attached to each opposing end of said second axle such that said drive sprocket and said stabilizer sprockets are driven at substantially equivalent rates;

a closed loop hydraulic dampening assembly coupled to said axle of said motor for dampening purposes and emergency descent capabilities, wherein said dampening assembly includes a hydraulic fluid reservoir in fluid communication with a dampening pump, an adjustable relief valve in fluid communication with and positioned between said dampening pump and said hydraulic fluid reservoir for restricting fluid flow along a first flow path to said dampening pump from said hydraulic fluid reservoir when said platform traverses said stationary, substantially linear roller chains in a first direction, a unidirectional check valve in fluid communication with and positioned between said dampening pump and said hydraulic fluid reservoir for free fluid flow along a second flow path to said dampening pump from said hydraulic fluid reservoir when said platform traverses said stationary, substantially linear roller chains in a second direction, and hydraulic fluid in said hydraulic fluid reservoir and said dampening pump; and a braking assembly coupled to said axle of said motor.

2. The elevator climbing system of claim 1 wherein said braking assembly includes a rotor attached to said axle, at least one caliper, said caliper having brake pads actuated by spring pressure, said caliper in fluid communication with a brake fluid reservoir and an actuator to engage said brake pads to or disengage said brake pads from said rotor.

3. The elevator climbing system of claim 2 wherein said spring pressure causes said brake pads to engage said rotor upon a predetermined decrease in pressure in said braking assembly.

4. The elevator climbing system of claim 3 wherein said braking assembly further comprises a depressible brake release pedal, said brake release pedal connected in communication with said actuator, wherein depression of said brake release pedal causes actuation of said actuator resulting in increased pressure in said braking assembly, said increased pressure causes said spring pressure to disengage said brake pads from said rotor.

5. The elevator climbing system of claim 3 further comprising at least one limit switch.

6. The elevator climbing system of claim 1 further comprising a self-contained, portable cantilevered bracket assembly.

7. The elevator climbing system of claim 6 wherein said cantilevered bracket assembly further comprises a pair of substantially vertical, triangular support members aligned in parallel, a substantially horizontal support bar having opposing ends attached to said triangular support members, said triangular support members having at least one latch to removably secure said cantilevered bracket assembly to an adjacent structure, said roller chains attached to said cantilevered bracket assembly.

8. The elevator climbing system of claim 7 wherein said adjacent structure is an oil derrick, a building, a water tower, a TV or radio tower, or a ship wind turbine tower.

9. The elevator climbing system of claim 6 wherein said cantilevered bracket assembly provides for proper alignment between said sprockets and said respective roller chains.

10. The elevator climbing system of claim 1 wherein said motor is electric, hydraulic or other rotating power supply.

11. The elevator climbing system of claim 1 further comprising a transmission coupled to said motor and said axle.

12. The elevator climbing system of claim 1 wherein said drive sprocket and said stabilizer sprockets are aligned in a substantially triangular orientation to stabilize said elevator climbing system.

13. The elevator climbing system of claim 1 further comprising an adjustable diaphragm pressure switch in fluid communication with said braking assembly, wherein said pressure switch monitors said pressure of said braking assembly, wherein said pressure switch causes said motor to start or stop at predetermined pressure points.

14. The elevator climbing system of claim 1 wherein said dampening pump is a low speed, high torque pump coupled to and driven by said axle of said motor for dampening purposes and emergency decent capabilities.

15. The elevator climbing system of claim 1 wherein said platform is an elevator car having a safety cage and at least one gate pivotally secured to said cage, wherein said elevator car travels up and down said roller chains.

16. The elevator climbing system of claim 1 wherein said elevator climbing system is portable.

17. A portable, self-contained elevator climbing system removably attachable to an adjacent structure, said system comprising:

a plurality of stationary, substantially linear roller chains having, individually addressable links, wherein at least one of said stationary, substantially linear roller chains is a drive chain, wherein at least one of said stationary, substantially linear roller chains is a stabilizer chain;

a platform constructed to traverse said stationary, substantially linear roller chains, said platform further comprising:

a motor having a primary axle;

a closed loop hydraulic dampening assembly coupled to said primary axle;

a braking assembly coupled to said primary axle, said braking assembly including at least one disc brake, said at least one disc brake having a caliper engagable with a rotor attached to said primary axle in response to a decrease in hydraulic pressure in said braking assembly;

an adjustable diaphragm pressure switch in fluid communication with said braking assembly, wherein said pressure switch monitors said hydraulic pressure of said braking assembly, wherein said pressure switch causes said motor to start or stop at predetermined pressure points;

a plurality of paired guide rollers, said guide rollers in each of said pairs being axially spaced and coaxially parallel;

a plurality of sprockets having radially projecting teeth, each of said sprockets being offset substantially perpendicularly from said axis of said paired guide rollers, wherein said paired guide rollers cause said roller chain to firmly engage said sprocket respectively, wherein at least one of said sprockets is a drive sprocket attached to said primary axle, wherein at least two of said sprockets are stabilizer sprockets connected via a linkage to said drive sprocket, wherein said drive sprocket and said stabilizer sprockets are aligned in a substantially triangular orientation to stabilize said elevator climbing system;

said linkage having a first linking sprocket attached to said primary axle, a second linking sprocket attached to a secondary axle having opposing ends and a linking chain forming a loop and engaged with said first and second linking sprockets, said stabilizer sprockets attached to each opposing end of said secondary axle such that said drive sprocket and said stabilizer sprockets are driven at substantially equivalent rates, wherein said primary axle and said secondary axle are substantially parallel; and a cantilevered bracket assembly removably securable to said adjacent structure, a end section of each of said stationary, substantially linear roller chains attached to said cantilevered bracket assembly, wherein said cantilevered bracket assembly provides proper alignment between said sprockets and said respective stationary, substantially linear roller chains;

wherein said elevator climbing system is portable.

18. The elevator climbing system of claim 17 wherein said caliper is actuated by spring pressure causing said caliper to engage said rotor upon a predetermined decrease in hydraulic pressure in said braking assembly.

19. The elevator climbing system of claim 18 said braking assembly further comprising a depressible brake release pedal, said brake release pedal connected in communication with an actuator, wherein depression of said brake release pedal causes actuation of said actuator resulting in increased hydraulic pressure in said braking assembly, said increased hydraulic pressure causes said spring pressure to disengage said brake pads from said rotor.

20. The elevator climbing system of claim 18 further comprising at least one limit switch.

21. The elevator climbing system of claim 17 wherein said motor is electric, hydraulic or other rotating power supply.

22. The elevator climbing system of claim 17 further comprising a transmission coupled to said motor and said primary axle.

23. The elevator climbing system of claim 17 wherein said hydraulic dampening assembly includes a hydraulic fluid reservoir in fluid communication with a dampening pump, an adjustable relief valve in fluid communication with and positioned between said dampening pump and said hydraulic fluid reservoir for restricting fluid flow along a first flow path to said dampening pump from said hydraulic fluid reservoir when said platform traverses said stationary, substantially linear roller chains in a first direction, a unidirectional check valve in fluid communication with and positioned between said dampening pump and said hydraulic fluid reservoir for free fluid flow along a second flow path to said dampening pump from said hydraulic fluid reservoir when said platform traverses said stationary, substantially linear roller chains in a second direction, and hydraulic fluid in said hydraulic fluid reservoir and said dampening pump, wherein said dampening pump is a low speed, high torque pump coupled to said axle of said motor for dampening purposes and emergency descent capabilities.

24. The elevator climbing system of claim 17 wherein said cantilevered bracket assembly further comprises a pair of substantially vertical, triangular support members aligned in parallel, a substantially horizontal support bar having opposing ends attached to said triangular support members, said triangular support members having at least one latch to removably secure said cantilevered bracket assembly to said adjacent structure.

25. The elevator climbing system of claim 17 wherein said adjacent structure is an oil derrick, a building, a water tower, a TV or radio tower, or a ship.

26. An elevator climbing system attached to an adjacent structure, said elevator climbing system comprising:

a plurality of stationary, substantially linear roller chains having individually addressable links, wherein at least one of said roller chains is a drive chain, wherein at least one of said roller chains is a stabilizer chain;

a cantilevered bracket assembly removably securable to said adjacent structure, wherein an end section of each of said stationary, substantially linear roller chains is attached to said cantilevered bracket assembly, and wherein said cantilevered bracket assembly provides proper alignment between said sprockets and said respective stationary, substantially linear roller chains;

an elevator car having a safety cage and at least one gate pivotally secured to said cage, wherein said elevator car travels up and down said stationary, substantially linear roller chains, said elevator car further comprising:

a motor having an axle;

a plurality of paired guide rollers, said guide rollers in each of said pairs being axially spaced and coaxially parallel;

a plurality of sprockets having radially projecting teeth, each of said sprockets being offset substantially perpendicularly from said axis of said paired guide rollers, wherein said paired guide rollers cause said roller chain to firmly engage said sprocket respectively, wherein at least one of said sprockets is a drive sprocket attached to said axle, wherein at least one of said sprockets is a stabilizer sprocket connected via a linkage to said drive sprocket;

a dampening assembly coupled to said axle of said motor for dampening purposes and emergency descent capabilities, wherein said dampening assembly includes a hydraulic fluid reservoir in fluid communication with a dampening pump, an adjustable relief valve in fluid communication with and positioned between said dampening pump and said hydraulic fluid reservoir for restricting fluid flow along a first flow path to said dampening pump from said hydraulic fluid reservoir when said elevator travels down said stationary, substantially linear roller chains, a unidirectional check valve in fluid communication with and positioned between said dampening pump and said hydraulic fluid reservoir for free fluid flow along a second flow path to said dampening pump from said hydraulic fluid reservoir when said elevator car travels up said stationary, substantially liner roller chains;

a braking assembly coupled to said axle of said motor, said braking assembly comprising a rotor attached to said axle and at least one caliper having brake pads actuated by spring pressure, wherein said caliper is in fluid communication with a brake fluid reservoir and an actuator to engage said brake pads to or disengage said brake pads from said rotor, wherein said spring pressure causes said brake pads to engage said rotor upon a predetermined decrease in pressure in said braking assembly; and at least one limit switch.

27. The elevator climbing system of claim 26 wherein said elevator climbing system is self-contained and portable.

28. The elevator climbing system of claim 27 wherein said cantilevered bracket assembly further comprises a pair of substantially vertical, triangular support members aligned in parallel, a substantially horizontal support bar having opposing ends attached to said triangular support members, said triangular support members having at least one latch to removably secure said cantilevered bracket assembly to an adjacent structure, said roller chains attached to said cantilevered bracket assembly.

29. The elevator climbing system of claim 26 wherein said motor is electric, hydraulic or other rotating power supply and a transmission is coupled to said motor and said axle.

30. The elevator climbing system of claim 26 wherein said linkage includes a first linking sprocket attached to said axle of said motor, a second linking sprocket attached to a second axle having opposing ends and a linking chain forming a loop and engaged with said first and second linking sprockets, said stabilizer sprockets attached to each opposing end of said second axle such that said drive sprocket and said stabilizer sprockets are driven at substantially equivalent rates.

31. The elevator climbing system of claim 26 wherein said drive sprocket and said stabilizer sprockets are aligned in a substantially triangular orientation to stabilize said elevator climbing system.

32. The elevator climbing system of claim 26 wherein said braking assembly further comprises a depressible brake release pedal, said brake release pedal connected in communication with said actuator, wherein depression of said brake release pedal causes actuation of said actuator resulting in increased pressure in said braking assembly, said increased pressure causes said spring pressure to disengage said brake pads from said rotor.

33. The elevator climbing system of claim 26 further comprising an adjustable diaphragm pressure switch in fluid communication with said braking assembly, wherein said pressure switch monitors said pressure of said braking assembly, wherein said pressure switch causes said motor to start or stop at predetermined pressure points.

34. The elevator climbing system of claim 26 wherein said adjacent structure is an oil derrick, a building, a water tower, a TV or radio tower, or a ship.

* * * * *